United States Patent [19]

Hosoya et al.

[11] Patent Number: 4,598,991

[45] Date of Patent: Jul. 8, 1986

[54] DEVELOPING DEVICE

[75] Inventors: Masahiro Hosoya, Yokohama; Tsutomu Uehara, Yokosuka; Takefumi Nosaki, Yokohama, all of Japan

[73] Assignee: Tokyo Shibaura Denki Kabushiki Kaisha, Kawasaki, Japan

[21] Appl. No.: 594,528

[22] Filed: Mar. 29, 1984

[30] Foreign Application Priority Data

Mar. 31, 1983 [JP] Japan ..... 58-56054

[51] Int. Cl.[4] ..... G03G 15/08

[52] U.S. Cl. ..... 355/3 DD; 118/653; 118/656; 355/14 D

[58] Field of Search ..... 355/3 R, 3 DD, 14 D; 118/653, 656, 661, 654

[56] References Cited

U.S. PATENT DOCUMENTS

| | | | |
|---|---|---|---|
| 3,257,223 | 6/1966 | King | 118/654 X |
| 3,974,796 | 8/1976 | Murray et al. | 118/654 X |
| 3,991,712 | 11/1976 | Genthe et al. | 118/637 |
| 4,067,295 | 1/1978 | Parker et al. | 355/3 DD X |
| 4,412,733 | 11/1983 | Doutney | 355/3 DD |

*Primary Examiner*—Fred L. Braun

*Attorney, Agent, or Firm*—Cushman, Darby & Cushman

[57] ABSTRACT

In a developing device for supplying developer to latent images formed on an image support, a container in which the developer is contained has a sloping bottom. The container has an opening in its top so as to release the developer particles therethrough. The container houses a developer carrier, which is arranged above the sloping bottom of the container with one end located on the lower side of the sloping bottom of the container immersed in the developer particles, and with its other end located on the higher side of the sloping bottom thereof. The developer carrier has a plurality of linear electrodes arranged thereon, starting from one end to the other end, and has an electric field generator connected to these linear electrodes to successively apply voltages to these electrodes so as to generate an electric field which advances according to a lapse of time, whereby the developer particles are carried along the developer carrier, from one end to the other. That part of the developer particles which does not contribute to the developing of the image is also carried from near the opening to the other end, where it slides down by its own weight on the sloping bottom of the container to return to and near the one end again.

13 Claims, 3 Drawing Figures

DEVELOPING DEVICE

BACKGROUND OF THE INVENTION

The present invention relates to a developing device for developing latent images formed on an image support which is used in, e.g., the electronic photographing or recording apparatus.

In a developing process of this type, developer is carried from its container to the image support by means of the developer carrier. Part of the carried developer is held on the image support to contribute to the developing of an image, while the rest is collected as residual developer, which does not contribute to the developing of the image. This residual developer is again returned to the container.

With the conventional developing device, a cylinder-like drum, for example is arranged as the developer carrier between the developing position adjacent to the image support and the container in which the developer is contained. When the drum is rotated, the drum surface picks up the developer from the container, carries it toward the image support, and then returns the amount left on the drum surface which does not assist in the developing of the image back to the container again. The conventional developing device therefore needs a driver means for driving the cylinder-like drum. In addition, a magnetic roll is arranged inside the drum to enable the drum surface to hold the developer. And this magnetic roll must also be driven. The conventional developing device which needs the driver means as described above can become complicated, large-sized and high in cost accordingly.

SUMMARY OF THE INVENTION

The object of the present invention is to provide a developing device, simpler in construction, smaller in size and lower in cost which serves to supply developer to the image support and collect that part of the developer which does not contribute to the developing of an image.

According to an aspect of the present invention, there is provided a developing device for developing a latent image formed on the image support by supplying developer to the image support comprising: a box-like container for containing the developer therein which has a sloping bottom and an opening through which the developer is released to the image support; a developer carrier arranged inside the container, with one end located on the lower side of the sloping bottom of the container which is immersed in the developer when the developer is contained in the container, and with the other end located on the higher side of the sloping bottom thereof, said developer carrier being placed near the opening of the container, and having a plurality of electrodes arranged thereon to hold developer and to carry it from one end to the other end; and an electric field forming means for applying voltage to the electrodes on the developer carrier successively, starting from one end to the other of the developer carrier, to form an electric field on the developer carrier which advances from one end to the other of the developer carrier, and which passes near the opening of the container following the path of the developer as it is carried by the developer carrier from one end to the other. That part of the developer which does not contribute to the developing of an image is then returned to the developer container by means of the container's sloping bottom and so is able to enter the developer carrier once again.

According to the developing device of the present invention, the following effects can be attained:

(1) Upon supplying and collecting the developer, the developer carrier needs no driver means, thereby allowing the developing device to be made simpler in construction, smaller in size and lower in cost.

(2) Since an alternating field is generated on the surface of the developer carrier, the developer can drift for a considerable distance, thereby allowing the distance between the developer carier and the image support to be made larger.

(3) It is unnecessary to mechanically drive the developer carrier and so no mechanical vibration can affect the developer carrier, thereby allowing the distance between the developer carrier and the image support to be always and accurately held certain.

(4) Only the developer which is charged enough to be able to be drifted by the alternating field contributes to the developing of latent images formed on the image support, thererby preventing the image from being fogged.

(5) The developer on the surface of the developer carrier is smoked and is therefore prevented from becoming self-coagulating, thereby allowing a sharp and fine image, rich gradation and edge effect, to be obtained.

(6) The image support is not damaged and broken thanks to non-contact development. In addition, a second development can be done without putting into disorder the developer which has adhered to the latent image, thereby allowing the developing device to be applied to color development.

DETAILED DESCRIPTION OF THE PREFERRED EMBODIMENT

An embodiment of the present invention will be described in detail referring to FIGS. 1 through 3.

Figure 1:
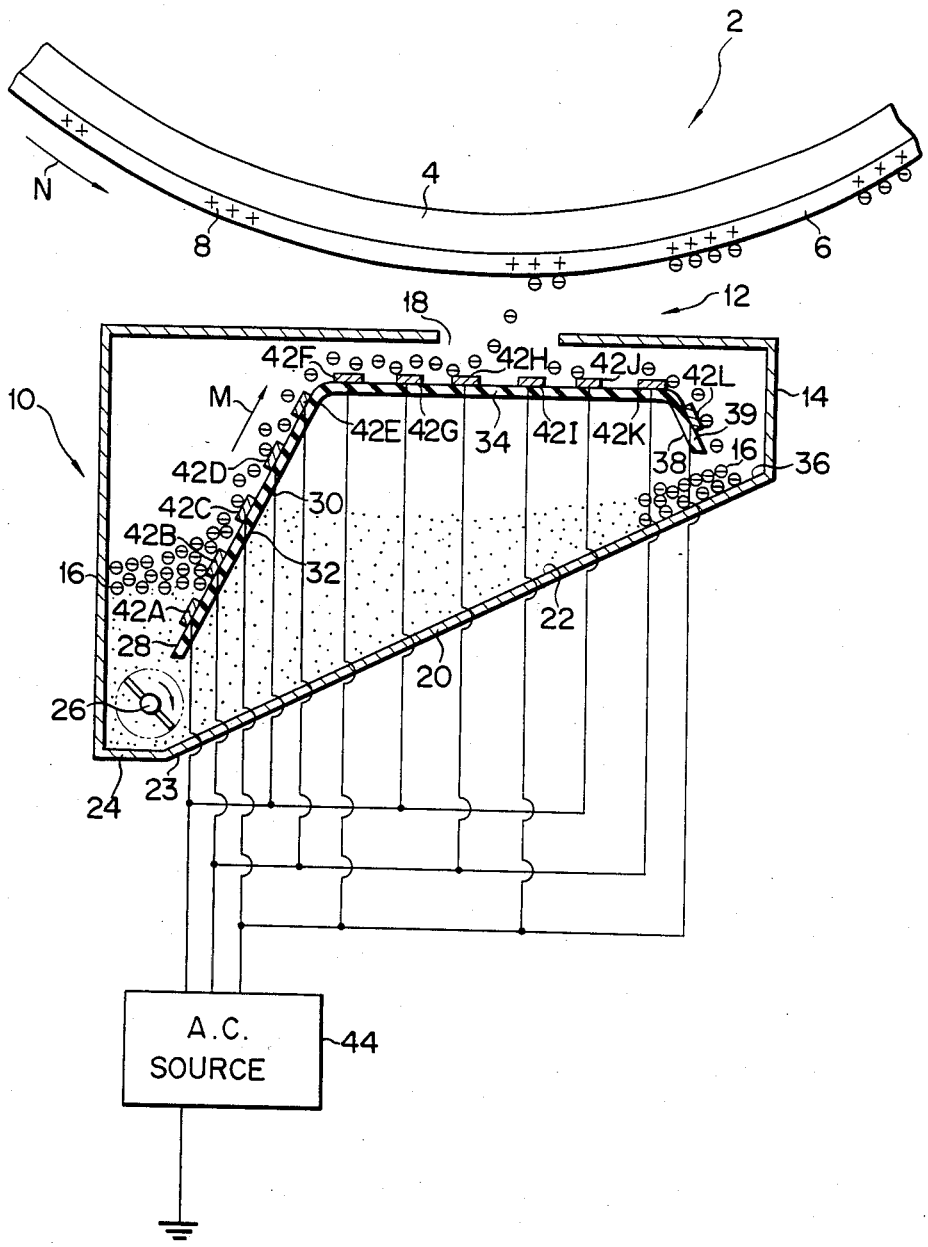
FIG. 1 is a sectional view roughly showing the example of a developing device according to the present invention.
Figure 2:
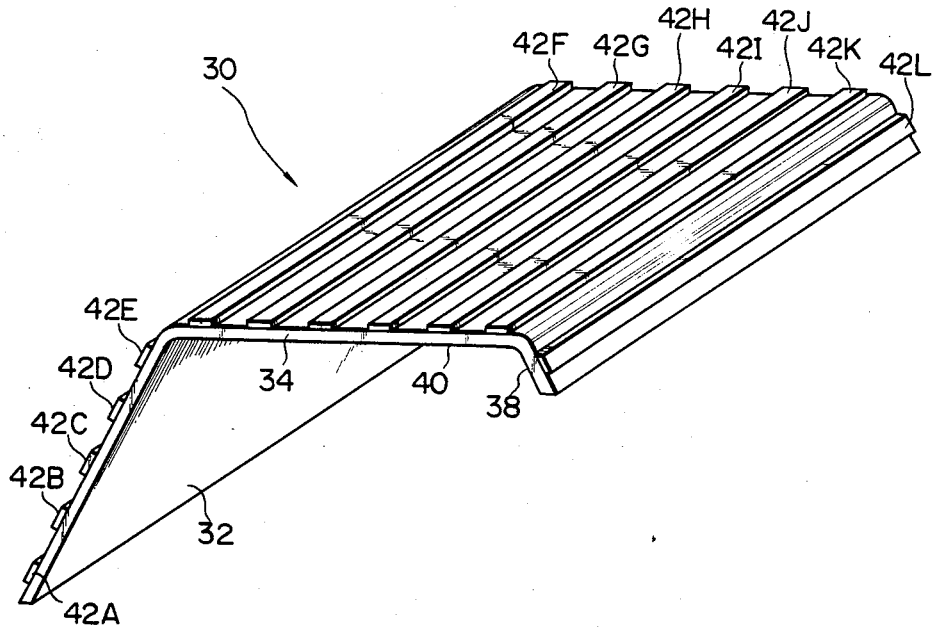
FIG. 2 is a perspective view showing the developer carrier in FIG. 1.

As shown in FIG. 1, a photosensitive body (image support) 4 on which latent images are formed is arranged in an electronic copying machine 2. The photosensitive body 4 is made of aluminum and shaped like a drum, on the lateral surface of which is formed a sensitive layer 6 of a Se-Te (selenium-Tellurium) system. Both of the charging and exposing means (not shown) are located near and around the photosensitive body 4, and a static latent image 8 plus-charged to 300–800 V, for example, is formed ahead of time on the photosensitive body by means of these charging and exposing means. The photosensitive body 4 is rotated at a periphery speed of about 180 mm/sec counterclockwise as shown by an arrow N.

The latent image 8 formed on the photosensitive body 4 is developed when it reaches the developing position where it faces a developing device 10 of the present invention. Formation of latent images is not limited to charging and exposing, but a pattern which corresponds to an image to be formed may be formed by means of the cathode ray tube or laser light. Or latent images may be formed by statically-charged dot patterns through the cat-whisker light-emitting diode.

Toner 16 is contained as developer in a box-like container 14 of the developing device 10. The box-like container 14 has an opening 18 in the top through which toner drifts from the container to the photosensitive body 4. The bottom 20 of the container 14 is slanted to form a slope 22 on which the toner slides down. The lowermost end portion 24 extends horizontally from the lowermost end 23 of the slope 22. Therefore, the toner slides down on the slope 22 and is then collected on and near the lowermost end portion 24. Arranged near the lowermost end portion 24 is an agitator 26 for agitating the toner collected near the lowermost end portion 24.

Arranged in the box-like container 14 is a developer carrier 30 for carrying toner from near the lowermost end portion 24 where it is collected, or from its lower end portion 28 to the opening 18. The developer carrier 30 extends from the lowermost end portion 24 to the uppermost end portion 36 of the slope 22. As shown in detail in FIG. 2, the developer carrier 30 is made of a plate member and formed to have a substantially L-shape. More specifically, the developer carrier 30 has a first sloping portion 32 extending obliquely and upward from its lower end portion 28, a substantially horizontal portion 34 extending substantially parallel to the top of the container 14 in which the opening 18 is formed, and a second sloping portion 38 extending downward from its horizontal portion 34 to the uppermost end portion 36 of the slope 22, these sloping and horizontal portions being made continuous and integral to one another. As shown in FIG. 1, the lower end portion of the first slope 32 is immersed in the toner 16, but the lower end 39 of the second slope 38 is separated from the toner 16. The photosensitive body 4 is separated by about 2 mm from the substantially horizontal portion 34 of the developer carrier 30 with the opening 18 interposed between them. The body 40 of the developer carrier 30 is made of insulating material and has a plurality of linear copper electrodes which are arranged equidistantly on the surface thereof, starting from the lower end of the first slope 32 to the end of the second slope 38 thereof in the order of 42 A–42 L. The linear electrodes are separated from each other by 0.2 mm. Each linear electrode is 0.5 mm wide and 5 $\mu$m thick, in the case of the embodiment.

These linear electrodes are connected to an AC source 44. Three kinds of AC voltages each different from the other in phase are supplied from the AC source 44. As the AC source, there is employed a three-phase AC source whose voltages are shifted 120° from one another. First-phase AC voltage is applied to the linear electrodes 42A, 42D, 42G and 42J; second-phase AC voltage is shifted 120° from the first-phase voltage to the linear electrodes 42B, 42E, 42H and 42K; and third-phase AC voltage is further shifted 120° in phase from the second-phase voltage to the linear electrodes 42C, 42F, 42I and 42L. When the linear electrodes are connected like this, waves of voltages are generated, advancing successively and relatively from 42A to 42L in the direction shown by an arrow M in FIG. 1. Since the alternating filed of the progressive wave type is generated in the direction M, therefore, the charged toner 16 near the linear electrode 42A is carried toward the linear electrode 42L. In other words, the toner 16 near the lower end portion 28 moves upward along the first slope and then passed through the opening 18, moving on the substantially horizontal portion of the developer carrier 30. Only part of the toner 16 develops the static latent image formed on the photosensitive body 4, the rest of the toner 16 (or residual toner) continues to move on the substantially horizontal portion to the end 39 of the second slope 38 where the residual toner drops to the uppermost end portion 38 of the slope 22. The residual toner then slides down by its own weight on the slope 22 to return to and near the lower end portion 28 of the developer carrier 30.

Voltage applied from the AC source 44 to each of the linear electrodes is set at about 450 V, for example. Its frequency is preferably higher than 100 Hz, but 100 Hz is used in the case of this embodiment.

Figure 3:
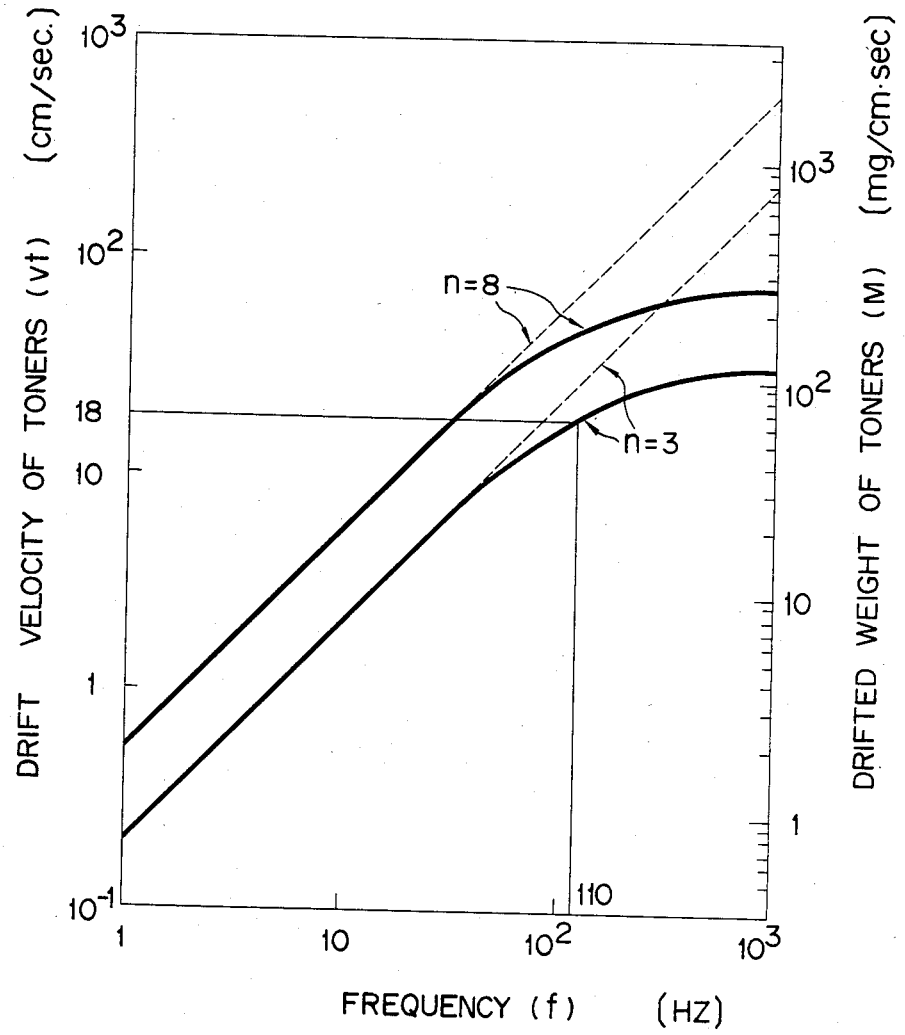
FIG. 3 is a diagram showing the relationship between the frequency of alternating field, the carrying speed and the amount of developer.

Referring to FIG. 3, there will be described the relationship between the frequency and carrying speed (drifting velocity) and amount of toner (drifted weight).

Under the conditions that the width (l) of linear electrode is 0.5 mm, the distance (l') between the linear electrodes is 0.2 mm and that AC voltage (V) is applied to linear electrodes 450 V, the drifted weight and drifting velocity of the toner particles are plotted while changing the frequency F from 1 Hz to 1 KHz. In FIG. 3, (n) represents the number of different phases, and (n=3) represents the relationship between the frequency and the drifted weight of the toner particles when three-phase AC voltage is applied; (n=8) represents another relationship when eight-phase AC voltage is applied. In the case of being three-phase AC voltage (n=3), therefore, the shift of the frequency from its adjacent ones is 120° because 360/3=120. When eight-phase AC voltage (n=8) is used, it is 45° because 360/8=45. The drifted weight of toner particles is usually represented by an equation ($M=v_f m$), wherein (m) represents the weight of the toner particles which are present per 1 $cm^2$ on the surface of the toner carrier when the progressive wave is stopped and $v_f$ represents the drifting velocity.

In the test shown in FIG. 3, it was found that m=4 $mg/cm^2$. It is usually required that $m \geqq 1.5$ $mg/cm^2$ for the purpose of obtaining a fine image by developing its latent image. In the test, therefore, the toner particles were found to have a sufficient weight.

In the case where the frequency (f) was lower than $10^2$, the flow of toner particles was not smooth. Therefore, it is preferable that the frequency (f) be higher than $10^2$. In non-contacting development, to get a good developed image which does not have partial concentration, the drifting speed of toner particles is substantially the same as the peripheral speed of the photosensitive body. Since the peripheral speed of the photosensitive body is 180 mm/sec in the case of this embodiment, the frequency is set at about 110 Hz from FIG. 3. It is certain that the peripheral speed of the photosensitive body is determined depending upon the relationship between the sensitivity of material of which the photosensitive body is made and of the other means arranged around the photosensitive body. After the drifting speed of the toner particles, which are carried according to the peripheral speed of the photosensitive body, is imagined, therefore, the frequency (f) can be determined. Broken lines in FIG. 3 denote the theoretical values.

According to the above-described embodiment, the toner particles 16 are carried from the lower end portion 28 of the box-like container 14 to the opening 18 adjacent to the developing position of the photosensitive body along the developer carrier 30. The moving toner particles rub together and are sufficiently charged by friction with the surface of the developer carrier 30. The toner particles thus carried and charged drift like a cloud near the opening 18, and adhere to the latent image formed on the photosensitive body to develop it.

That part of the toner particles which does not contribute to the developing of an image is further carried along the developer carrier 30 to the end 39 of the second slope 38, where it falls down by its own weight onto the uppermost end portion 36 of the sloping bottom 22 of the container 14. These toner particles which have fallen down onto this uppermost end portion 36 slide down on the sloping bottom 22 of the container 14 to again return to the lower end portion 28 of the developer carrier 30.

It should be understood that the present invention is not limited to the above-described embodiment and that various kinds of modifications can be allowed within the spirit and scope of the present invention.

The same effects can also be attained using four-, six- or eight-phase AC source, instead of a three-phase one, for generating a progressive wave due to electric field.

Although the present invention has been described referring to the case where development is carried out using one color of toner particles, it may be applied to color development. In this case, plural developing devices are employed and each color of the toner particles is used in each of these developing devices.

Although the surface of the developer carrier on which the linear electrodes are arranged has been made uneven, the same effects can also be achieved even when it is made even.

Although AC voltages which are shifted in phase from one another have been applied to the linear electrodes, DC voltage may be applied successively to each of the linear electrodes to generate an electride field which advances according to the lapse of time.

What is claimed is:

1. A developing device for developing a latent image formed on an image support by supplying developer to the image support comprising:

container means for containing the developer therein and defining an opening through which the developer is released to the image support, said container means including a sloping bottom member;

a stationary developer carrier arranged inside the container at a location above the sloping bottom member, one end of said developer carrier being located near a lower side of said sloping bottom member of said container means and being immersed in the developer which accumulates at said lower side, said developer carrier having its other end located near a higher side of said sloping bottom member, said developer carrier extending between said one and other ends so as to dispose a portion of said developer carrier near said opening of said container means, said developer carrier also having a plurality of linear electrodes arranged thereon; and electric field generator means for applying voltages to said linear electrodes on the developer carrier successively, starting from said one end to said other end of the developer carrier, to responsively generate an electric field on the developer carrier which electric field advances from said one end to said other end of the developer carrier according to a predetermined time lapse, wherein said electride field generator means and said plurality of linear electrodes together comprise the means for carrying the developer along the developer carrier in a direction starting from said one end of said developer carrier towards said other end thereof by virtue of said advancing electric field so that a portion of the developer upon being carried to said developer carrier portion, is transferrable through said opening to be deposited upon the image support thereby to develop the latent image thereon and so that a residual portion of the developer which does not contribute to the developing of the latent image is further carried from said opening to said other end of the developer carrier to be deposited at said higher side of said sloping bottom member, wherein the developer then slides down by its own weight upon said sloping bottom member of said container means to accumulate at said lower side near said one end of said developer carrier.

2. A developing device according to claim 1, wherein said electric field generator means includes AC source means for applying AC voltages, which are shifted in place from one another, to each of said linear electrodes successively.

3. A developing device according to claim 2, wherein said AC source means is of three-phase type so as to apply AC voltages, whose phases are shifted 120° from one another, to each of the linear electrodes successively.

4. A developing device according to claim 3, wherein said AC source means applies voltages which have a frequency which makes a drifting speed of the developer carried along the developer carrier substantially the same as that of the latent image formed on the image support.

5. A developing device according to claim 3, wherein the frequency of the AC voltages applied from the AC source to each of the electrodes is higher than 100 Hz.

6. A developing device according to claim 1, wherein a bottom wall of said container means serves as said sloping bottom member.

7. A developing device according to claim 1, wherein the developer carrier includes a first sloping portion extending upwardly from said one end thereof, a second sloping portion extending downwardly at said other end thereof, and a horizontal portion extending subjacently to the opening of said container means so as to bridge said first and second sloping portions.

8. A developing device according to claim 1, wherein said container means houses an agitator adjacent to said one end of said developer carrier.

9. A developing device for developing a latent image upon an image support by supplying developer particles to the image support, said device comprising:

container means for containing a quantity of developer particles and defining an opening in confronting relationship to a portion of the image support to thereby establish a developing position;

a stationary developer carrier housed within said container means and having one end in operative communication with said quantity of said developer particles and having another end, said developer carrier, between said one end and another ends thereof, defining an area which is in subjacent registry with said opening of said container means; and means for propagating electric fields which advances from said one end to said another end of said developer carrier, said propagating electric fields thereby carrying said developer particles along said developer carrier in a transfer direction from said one end towards said another end thereof so that a portion of said developer particles, upon being carried to said defined area of said developer carrier, are transferrable to the image support through said opening, wherein said means for propagating electric fields includes:

(a) plural electrodes disposed on said developer carrier between said one and another ends substantially transverse to said transfer direction, each said electrode being spaced apart relative to adjacent ones of said electrodes; and (b) voltage applying means for applying voltages to said electrodes successively from said one end to said another end to thereby responsively generate said advancing electric fields.

10. A developing device as in claim 9 wherein said developer carrier includes a first portion which includes said one end and which is upwardly inclined in said transfer direction, a last portion which includes said another end and which is downwardly inclined in said transfer direction, and an intermediate portion which includes said defined area and which joins said first and last portions.

11. A developing device as in claim 10 wherein said container means includes means defining a sloped wall to thereby establish (a) a lower side of said container means near said one end of said developer carrier, and (b) a higher side of said container means near said another end of said developer carrier, whereby those of said developer particles not transferred to the image support through said opening proceed on to said another end fall to said sloped wall, said sloped wall thereby encouraging those of said developer particles not transferred to the image support through said opening to slide towards said lower side of said container means to be accumulated thereat.

12. A developing device as in claim 9 wherein said container means includes means defining a sloped wall to thereby establish (a) lower side of said container means near said one end of said developer carrier, and (b) a higher side of said container means near said another end of said developer carrier, whereby those of said developer particles not transferred to the image support through said opening proceed onto said another end fall to said sloped wall, said sloped wall thereby encouraging those of said developer particles not transferred to the image support through said opening to slide towards said lower side of said container means to be accumulated thereat.

13. A developing device as in claim 12 wherein said lower side of said container means includes agitator means for agitating said accumulated developer particles.

* * * * *